US008899347B2

(12) United States Patent
Sarhad et al.

(10) Patent No.: US 8,899,347 B2
(45) Date of Patent: Dec. 2, 2014

(54) SYSTEM AND METHOD OF USING A SAVER SUB IN A DRILLING SYSTEM

(75) Inventors: Shardul Sarhad, Stafford, TX (US); Michael Ross, Needville, TX (US); Michael Sakach, Sugar Land, TX (US); Michael Mitchell, Sugar Land, TX (US); Ming Lai, Sugar Land, TX (US); Mark Sherman, Oslo (NO)

(73) Assignee: Intelliserv, LLC, Houston, TX (US)

( * ) Notice: Subject to any disclaimer, the term of this patent is extended or adjusted under 35 U.S.C. 154(b) by 737 days.

(21) Appl. No.: 12/397,983

(22) Filed: Mar. 4, 2009

(65) Prior Publication Data

US 2010/0224409 A1 Sep. 9, 2010

(51) Int. Cl.

| | |
|---|---|
| ***E21B 47/01*** | (2012.01) |
| ***E21B 47/00*** | (2012.01) |
| ***B23P 11/00*** | (2006.01) |
| ***G01V 3/00*** | (2006.01) |
| ***E21B 17/00*** | (2006.01) |
| ***E21B 19/16*** | (2006.01) |
| ***E21B 21/10*** | (2006.01) |
| ***E21B 47/12*** | (2012.01) |

(52) U.S. Cl.

CPC ..... *E21B 17/003* (2013.01); *E21B 19/16* (2013.01); *E21B 21/106* (2013.01); *E21B 47/12* (2013.01)

USPC ..... 175/40; 175/50; 340/853.9; 340/854.4; 340/855.1

(58) Field of Classification Search

USPC ..... 175/40, 50; 340/853.9, 854.4, 854.9, 340/855.1, 855.2, 855.8

See application file for complete search history.

(56) References Cited

U.S. PATENT DOCUMENTS

| | | | | |
|---|---|---|---|---|
| 4,491,022 | A | 1/1985 | de la Cruz | |
| 4,616,321 | A | 10/1986 | Chan | |
| 5,144,126 | A | 9/1992 | Perry et al. | |
| 6,267,185 | B1 | 7/2001 | Mougel et al. | |
| 6,429,787 | B1 * | 8/2002 | Pyne | 340/870.31 |
| 6,956,791 | B2 * | 10/2005 | Dopf et al. | 367/82 |
| 7,108,081 | B2 | 9/2006 | Boyadjieff | |
| 7,591,304 | B2 | 9/2009 | Juhasz et al. | |
| 7,757,759 | B2 | 7/2010 | Jahn et al. | |
| 7,980,331 | B2 * | 7/2011 | Hall et al. | 175/320 |
| 2001/0049049 | A1 * | 12/2001 | Hensley et al. | 429/50 |
| 2002/0039328 | A1 | 4/2002 | Dubinsky et al. | |
| 2002/0156730 | A1 | 10/2002 | Newman | |
| 2004/0251048 | A1 * | 12/2004 | Kurkoski | 175/41 |
| 2005/0056461 | A1 | 3/2005 | Estes et al. | |

(Continued)

FOREIGN PATENT DOCUMENTS

WO 2003058029 7/2003

OTHER PUBLICATIONS

Search Report and Written Opinion dated Oct. 15, 2010 for International Application No. PCT/US2010/026146, 10 pages.

(Continued)

*Primary Examiner* — James G Sayre
(74) *Attorney, Agent, or Firm* — Conley Rose, P.C.

(57) ABSTRACT

A technique facilitates the drilling of a wellbore by enhancing the ability to relay data. The system comprises a saver sub designed to connect a top drive unit with a wired drill pipe without requiring modification of the top drive unit. The saver sub comprises an electronics package, a battery, and an antenna coupled to a saver sub mandrel.

16 Claims, 7 Drawing Sheets

(56) References Cited

U.S. PATENT DOCUMENTS

| | | | | |
|---|---|---|---|---|
| 2006/0219438 | A1* | 10/2006 | Moore et al. | 175/50 |
| 2007/0017682 | A1 | 1/2007 | Abrahamsen et al. | |
| 2007/0030167 | A1 | 2/2007 | Li et al. | |
| 2008/0007421 | A1 | 1/2008 | Liu et al. | |
| 2008/0033653 | A1 | 2/2008 | Pabon et al. | |
| 2008/0164025 | A1 | 7/2008 | Peter | |
| 2008/0202810 | A1* | 8/2008 | Gomez | 175/40 |
| 2009/0134863 | A1 | 5/2009 | Takanohashi et al. | |
| 2010/0051292 | A1 | 3/2010 | Trinh et al. | |
| 2010/0224409 | A1 | 9/2010 | Sarhad et al. | |
| 2011/0098931 | A1 | 4/2011 | Kosmala et al. | |
| 2012/0080227 | A1 | 4/2012 | Cardellini et al. | |

OTHER PUBLICATIONS

Besaisow et al., "Application of ADAMS (Advanced Drillstring Analysis and Measurement System) and Improved Drilling Performance," SPE 19998, SPE Annual Technical Conference and Exhibition, Feb. 27-Mar. 2, 1990, Houston, Texas.

Besaisow et al., "Development of a Surface Drillstring Vibration Measurement System," SPE 14327, SPE Annual Technical Conference and Exhibition, Sep. 22-26, 1985, Las Vegas, Nevada.

* cited by examiner

SYSTEM AND METHOD OF USING A SAVER SUB IN A DRILLING SYSTEM

BACKGROUND OF THE INVENTION

The present invention relates generally to a saver sub and a system and a method for using a saver sub in a drilling system.

FIG. 1 illustrates a typical drilling system 300 for use in drilling to recover oil and gas deposits within the Earth. The system 300 is a land-based rig, however, the principles and equipment described herein may also apply to an off-shore rig used to drill into the Earth's crust beneath the ocean or other body of water. The system 300 includes a rig 301 from which a drill string 304 is suspended into a wellbore 302. A drill bit 306 at the lower end of the drill string 304 is used to drill the wellbore 302. The surface systems may include a hook 312 for suspending at least a portion of the weight of the drill string 304, as well as a rotary swivel 314, which allows the drill string to rotate relative to the hook 312. A rotary table 308 may be used to rotate the drill string 304. Another system to rotate the drill string 304 is called a "top drive" system, which may be used instead of a rotary table.

The drill string 304 is typically comprised of several sections of drillpipe 338 connected together, end-to-end, to form the drill string 304. At the lower end, the drill string 304 includes a bottom hole assembly ("BHA") 326 and a drill bit 306. The BHA 326 comprises sensors and other equipment for collecting data related to the direction and inclination of the bottom hole assembly, pressure and temperature data, and formation property data, such as porosity, permeability, resistivity, density, hydrogen content, and other downhole properties. The sensors may be part of measurement-while-drilling ("MWD") or logging-while-drilling ("LWD") tools utilized in the BHA 326.

The system 300 also includes a surface computer 332 which may be used for any number of purposes. For example, the surface computer 332 may be used to store and/or interpret signals received from the BHA 326 or to control the rig. Reliably conveying data and/or power along a drill string has become an increasingly important aspect of wellbore drilling operations.

Numerous types of telemetry systems are commonly used in connection with MWD and LWD systems to communicate with the surface computer 332. For example, mud-pulse telemetry systems use modulated acoustic waves in the drilling fluid to convey data or information between the BHA 326 and the surface computer 332. However, mud-pulse telemetry systems have a relatively low data transmission rate of about 0.5-12 bits/second and, thus, substantially limit the amount of information that can be conveyed in real-time and, as a result, limit the ability of an oil company to optimize their drilling operations in real-time. Other telemetry systems such as electromagnetic telemetry (EM) via subsurface earth pathways and acoustic telemetry through drill pipe have been employed. These other telemetry systems also provide a relatively low data rate that may limit the ability of an oil company to employ sophisticated real-time data processing to optimize its drilling operations.

Wired drill pipe is an emerging technology that may be used to provide communication and power distribution to the BHA 326 and throughout the drilling system. For example, wired drill pipe may be used to transmit data from a measuring device in the BHA 326 to the surface computer 332. In other examples, wired drill pipe may be used to transmit data or instructions from an uphole system to the BHA 326. In addition, wired drill pipe may provide communications to and from sensors or other electronics positioned at points along the drill string.

In contrast to mud-pulse and electromagnetic telemetry systems, a wired drill pipe system can convey data at a relatively high rate along the length of a drill string. One example of a wired drill pipe system 200 is shown in FIG. 2, which illustrates three interconnected pipe sections 201*a*, 201*b*, 201*c*. The upper pipe section 201*a* is connected to the center pipe section 201*c* by mating the pin end 221*a* of the upper section 201*a* with the box end 210*c* of the center pipe section 201*c*. Likewise, the center pipe section 201*c* is connected with the lower pipe section 201*b* by mating the pin section 220 of the center pipe section 201*c* with the box end 210*b* of the lower pipe section 201*b*. In this manner, the drill string 104 may be created by mating adjacent sections of the drillpipe 138.

The center section 201*c* includes a communicative coupler 211 in the box end 210*c* of the pipe section 201*c*. When the upper pipe section 201*a* and the center pipe section 201*c* are connected, the communicative coupler 211 in the center pipe section 201*c* is located proximate a communicative coupler 221*a* in the box end 220*a* of the upper pipe section 201*a*. Likewise, a communicative coupler 221 in the pin end 220 of the center pipe section 201*c* may be proximate a communicative coupler 211*b* in the box end 210*b* of the lower pipe section 201*b*.

A wire 202 in the center pipe section 201*c* spans the length of the pipe section 201*c* and is connected to each communication coupler 211, 221. Accordingly, data and/or power transferred to from pipe section 201*a* and 201*b* may be transmitted through the wire to the communicative coupler 211, 221 at the opposing end of the pipe section 201*a*, 201*b*, where it may then be transferred to the next adjacent pipe section. The communicative couplers 211, 221 may be any type of couplers that enable the transfer of data and/or power between pipe sections. Such couplers include direct or galvanic contacts, inductive couplers, current couplers, and optical couplers, among others.

One example of a wired drill pipe is disclosed in U.S. Pat. No. 3,696,332, issued to Dickson, Jr., et al., which discloses a drill pipe with insulated contact rings positioned in a shoulder at both ends of the pipe. The contact rings in a single segment of pipe are connected by a conductor wire that spans the length of the pipe. When a segment of drill pipe is made up with an adjoining segment of pipe, the contact ring in the first segment of pipe makes contact with a corresponding contact in the adjacent pipe section.

When a wired drill pipe system is used, it is necessary to have a communication link between the topmost wired drill pipe and the surface computer 132 (which, inter alia, typically performs one or more of the following functions: receiving and/or sending data, logging information, and/or control information to and/or from downhole and surface equipment, performing computations and analyses, and communicating with operators and with remote locations). However, with existing techniques, the top drive system must be modified or special subs must be included in the drill string and such changes can significantly hinder normal drilling operations.

The present invention, therefore, provides an improved saver sub that may be secured to a drill string, whether wired or non-wired, to improve drilling operations. The saver sub may house electronics, one or more power sources, and/or one or more antennas for transferring data to the surface computer or other data processing or storing system.

BRIEF DESCRIPTION OF THE DRAWINGS

Certain embodiments of the invention will hereafter be described with reference to the accompanying drawings, wherein like reference numerals denote like elements, and.

DETAILED DESCRIPTION OF EMBODIMENTS OF THE INVENTION

Figure 1:
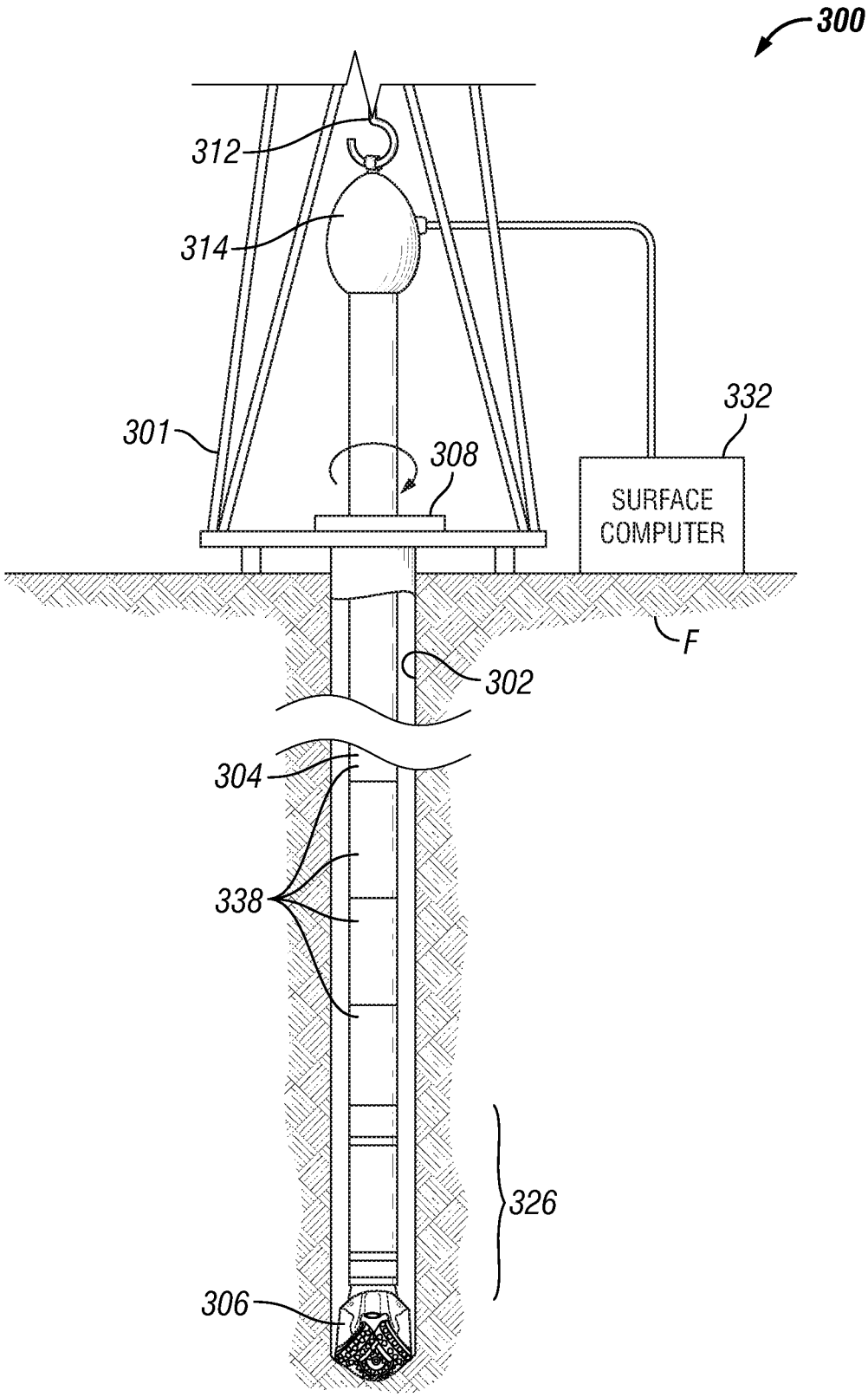
FIG. 1 is a prior art schematic front view of a drilling system for use in drilling a wellbore, according to an embodiment of the present invention.
Figure 2:
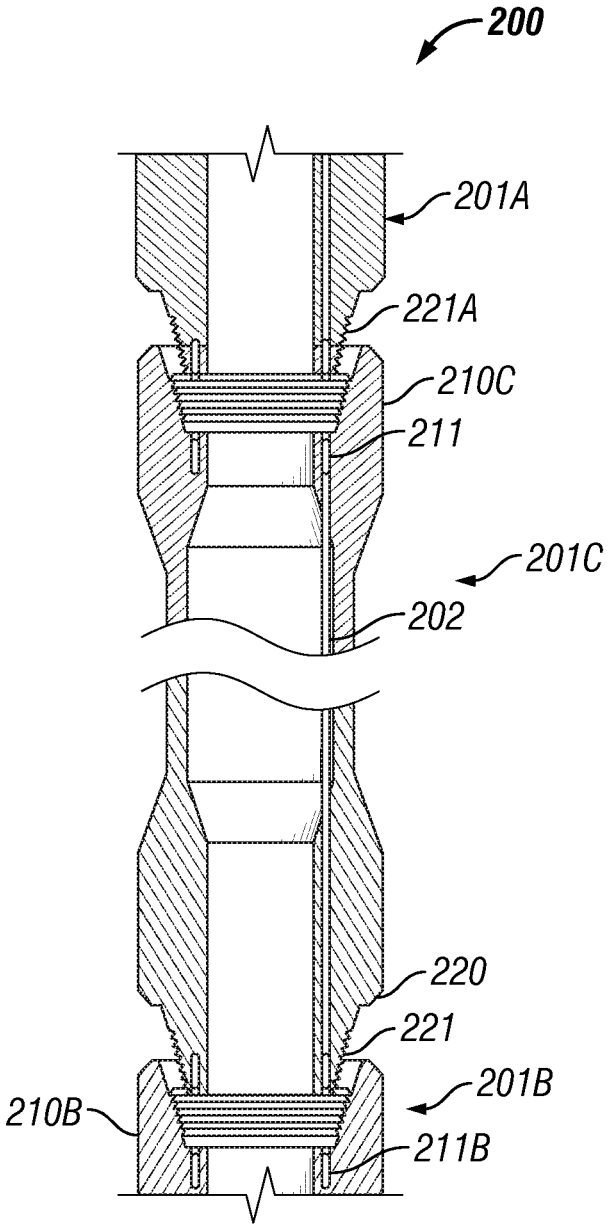
FIG. 2 is an illustration of a prior art wired drill pipe that may be used in an embodiment of the present invention.

The present invention will now be described with reference to FIGS. 3 through 12. However, while embodiments of the present invention are described for use with wired drill pipe, it should be clear that the present invention may be used with non-wired drill pipes. Therefore, the present invention should not be limited to any of the embodiments described or illustrated in the drawings and is covered by the appended claims to the fullest extent possible.

Figure 3:
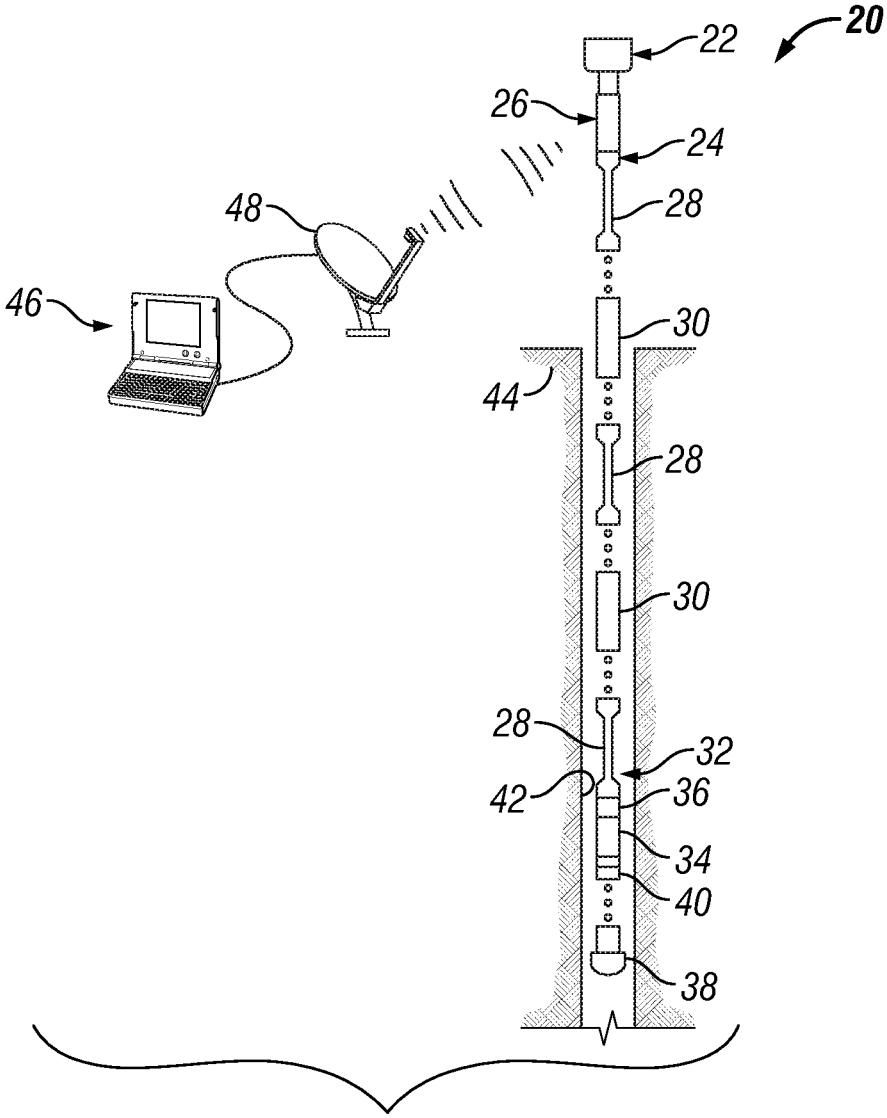
FIG. 3 is a schematic front view of a drilling system for use in drilling a wellbore, according to an embodiment of the present invention.
Figure 4:
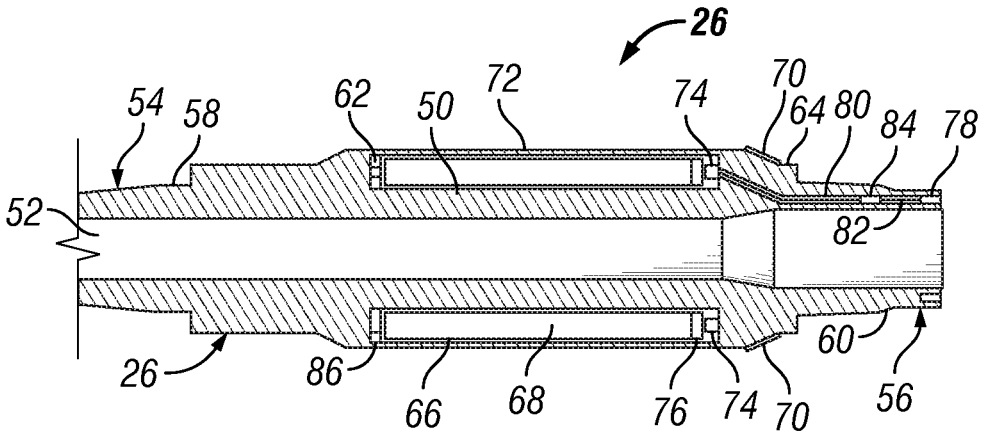
FIG. 4 is a cross-sectional view of an example of a saver sub for use in the drilling system illustrated in FIG. 3, according to an embodiment of the present invention.

The present invention generally relates to an apparatus, a system and a method for facilitating communication of signals between a control system and a drill string, such as a wired drill pipe system. Referring generally to FIG. 3, an example of a well system 20 is illustrated according to an embodiment of the present invention. In this embodiment, the well system 20 is a drilling system shown in exploded form and comprising a top drive 22 connected to a drill string 24 by a saver sub 26. The drill string 24 may be a wired drill string and may comprise a plurality of joints of drill pipe 28, such as wired drill pipe, connected by repeater subs 30, as needed, to receive and boost a signal flowing along the wired drill string 24.

A bottom hole assembly ("BHA") 32 may be connected at or adjacent to an end of the drill string 24. The bottom hole assembly 32 may consist of a variety of components depending on the particular drilling operation to be performed. A non-limiting example includes a drill bit 38 and a sensor assembly 34 that may include a measurement-while-drilling ("MWD") system and/or a logging-while-drilling ("LWD") system and/or other sensors. The sensor assembly 34 may be connected to the lowermost joint of the drill pipe 28 by an interface sub 36. The drill bit 38 may be connected to an optional downhole motor 40. The drill bit 38 may be rotated to form a wellbore 42 in a subterranean formation 44. It should be noted that additional and/or alternative components can be used in constructing the drill string 24 depending on the environment and operational parameters related to drilling the wellbore 42. For example, stabilizers, jars, reamers, and other drilling related tools may be utilized.

Signals may be transmitted or otherwise communicated along the joints of the drill pipe 28 and may be collected and amplified at each repeater sub 30. For example, sensor measurements from the sensor assembly 34 may be encoded and transferred along the drill string 24 via the interface sub 36. The signals may be received by the saver sub 26 and may be transferred to a control system 46, such as a computer-based processing system. By way of example, the signals may be processed for transfer to the saver sub 26 and transmitted to the control system 46. In an embodiment, the signals may be transmitted from the saver sub 26 to the control system 46 wirelessly via, for example, radiofrequency signals. The control system 46 may comprise an antenna 48 for receiving the signals. The control system 46 may demodulate and process the signals. The control system 46 and the saver sub 26 may be capable of two-way communication. The two-way communication enables transfer of signals both uphole and downhole. For example, control signals, measurements, and other information may be sent downhole to the sensor assembly 34, such as the LWD or MWD tools.

The saver sub 26 may be capable of supporting the entire load and torque at the top of the drill string 24. An embodiment of saver sub 26 is illustrated in cross-section in FIG. 4 as comprising a mandrel 50 having an internal flow passage 52 that extends generally axially through the mandrel 50 from an upper connection end 54 to a lower connection end 56. Internal flow passage 52 is sized to enable the flow of drilling mud under high pressure. Upper connection end 54 is sized and shaped for connection to the top drive 22 and may comprise a threaded region 58 for threaded engagement to the top drive 22. Lower connection end 56 is sized and shaped for connection to the drill string 24 and may comprise a threaded region 60 for threaded engagement with the drill string 24.

The mandrel 50 may have a recessed region 62, such as a radially recessed region that extends around a body section 64 of the mandrel 50 between ends 54 and 56. In the embodiment illustrated, electronics 66 and one or more batteries 68 may be positioned at the recessed region 62. The electronics 66 may be used to conduct and/or process signals transmitted along the drill string 24, such as between the drill string 24 and the control system 46. The batteries 68 may be used to power the electronics 66. The electronics 66 may be in communication with one or more saver sub antennas 70 that enable the wireless transfer of data to or from the antenna 48 of the control system 46.

The saver sub antenna 70 may be any antenna capable of transmitting a signal from a first location to a second location. For example, the saver sub antenna 70 may also comprise one or more antennas described in U.S. Patent Publication No. 2007/0030167 assigned to the same assignee as the present application, which is hereby incorporated by reference in its entirety. However, due to the physical and environmental constraints of a top drive saver sub, a normal patch, wire or dish antenna may be too large or cause reliability or operational problems when installed on the saver sub 26.

Figure 12:
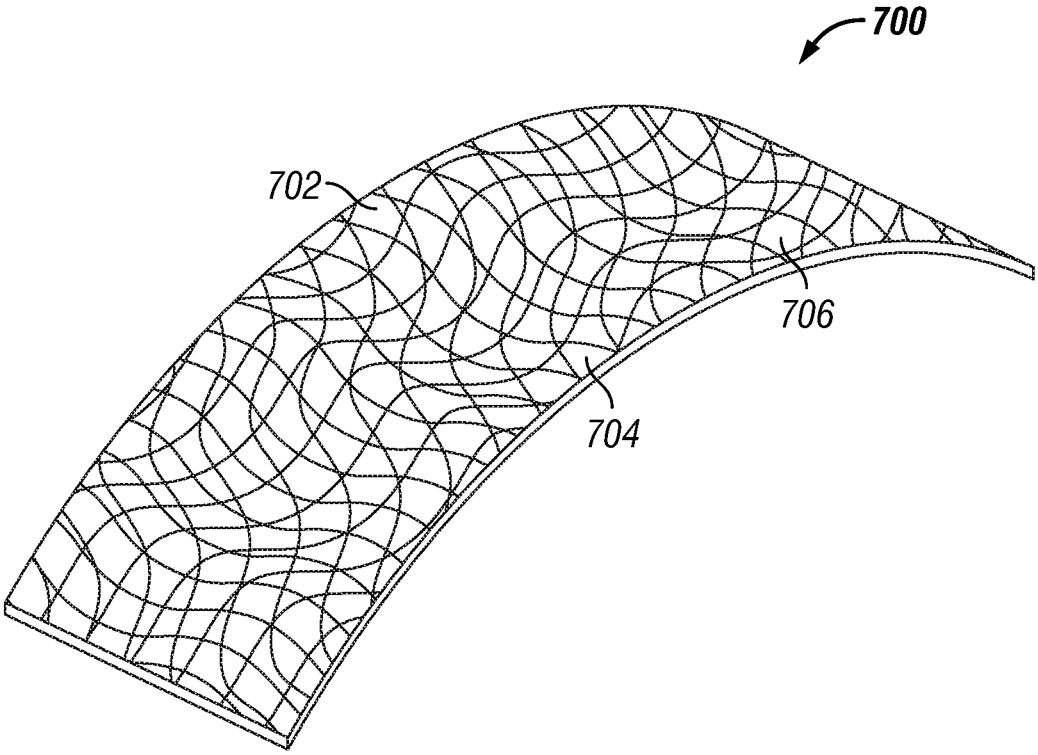
FIG. 12 illustrates an antenna that may be used in an embodiment of the present invention.

In an embodiment, the saver sub antenna 70 may be a micro-strip antenna 700 as shown in FIG. 12. The micro-strip antenna 700 may comprise two or more patch antennas or segments 702, 704, 706. The patch antennas or segments 702, 704, 706 may be joined by use of micro-strip lines. The micro-strip antenna 700 may be embedded into conductive traces, for example, copper-based, gold-based or any conductive material, and may be positioned on a printed circuit board or other substrate. The micro-strip antenna 700 may be tuned to a predetermined communication frequency by the pattern, length and width of the traces or by other methods as will be appreciated by those having ordinary skill in the art.

The micro-strip antenna 700 (as well as the other antennas described herein) may permit transmission and reception in substantially, if not all directions, such as 360 degrees coverage with respect to the saver sub 26. In such a case, the saver sub antenna 70 may provide communication even if the saver sub 26 is rotating or otherwise moved. The micro-strip antenna 700 may be particularly advantageous due to its inherent low profile and may be positioned within the outer diameter of the saver sub 26. The micro-strip antenna 700 may have a curved shape and/or may be substantially similar in shape to the outside diameter of the save sub 26. The low profile may allow installation into the saver sub 26 without affecting the mechanical integrity of the saver sub 26. Additionally, the low profile allows protection of the micro-strip antenna 700 during transportation, installation and use. For example, the micro-strip antenna 700 may be installed in the saver sub 26 such that the micro-strip antenna 700 is maintained below the surface of the saver sub 26, such as by positioning the saver sub antenna 70 in or proximate to the mandrel 50 or the recessed region 62 of the saver sub 26. Of course, as the micro-strip antenna 700 is an example of the saver sub antenna 70, the micro-strip antenna 700 may be positioned in any of the locations described with respect to the saver sub antenna 70.

In the embodiment illustrated, the electronics 66 and the batteries 68 are mounted or otherwise secured in a shell 72 that may be removably mounted in recessed region 62. The removable shell 72 enables installation of the saver sub 26 to the top drive 22 without creating the potential for damaging the electronics 66 and/or the batteries 68 when the mandrel 50 is secured to the top drive 22, such as by use of tongs to attach and torque the mandrel 50 to the top drive 22. The shell 72 containing the electronics 66 and the batteries 68 may be installed in the recessed region 62 of the mandrel 50 to enable communications along the drill string 24.

The saver sub 26 may include contacts 74, such as electrical contacts that may be in the form of direct contacts, toroid contacts, inductive contacts, or other suitable contacts. Contacts 74 may be positioned in body section 64 at a location suitable for cooperation with corresponding contacts 76 of shell 72. Engaging contacts 74 and 76 enables communication between electronics 66 and, for example, wired drill string 24/antenna 70 when shell 72 is installed into recessed region 62.

In the example illustrated, saver sub 26 comprises a connection end contact 78, such as an electrical contact, positioned and designed to form a communication link with the wired drill string 24 when a drill pipe 28 is connected with saver sub 26. For example, the connection end contact 78 may comprise an electrical contact that establishes electrical communication with a corresponding electrical contact in the wired drill pipe joint when threadably engaged with the saver sub 26. As illustrated, a passage 80 may be formed through the mandrel 50 to protect a communication line 82, e.g. one or more conductive wires, which extends between the connection end contact 78 and the corresponding contact 74. In some applications, a multi-pin pressure bulkhead connector 84 may be positioned within passage 80 between the connection end contact 78 and the corresponding contact 74. The bulkhead connector 84 can be used to prevent the transfer of pressure to the annulus in the event the pressure of the internal mud gains access to the contacts 78. If the bulkhead connector 84 is employed, the communication line 82 effectively has separate sections that connect between the bulkhead connector 84 and contacts 78, 74, respectively.

The shell 72 may be attachable or securable to the mandrel 50 by several techniques. For example, the shell 72 can be clamped, latched, connected by separate fasteners, or otherwise attached to mandrel 50. The shell 72 also may comprise or cooperate with one or more seals 86 that limit the flow of moisture or other substances to electronics 66 and/or batteries 68. Accordingly, the shell 72 enables the quick and easy removal and/or installation of electronics and batteries to facilitate a variety of procedural operations. As described above, for example, the electronics and batteries can be removed while saver sub 26 is attached or removed from top drive 22. Additionally, the shell 72 is easily removed to save the electronics 66 and batteries 68 for reuse when the saver sub 26/mandrel 50 becomes worn out or damaged to a degree that requires replacement. Shell 72 also enables the utilization of electronics 66 and batteries 68 in new or alternate saver subs which often saves time and reduces costs. The removable shell further facilitates the timely swapping of electronics when the batteries fail or are due for replacement.

Figure 5:
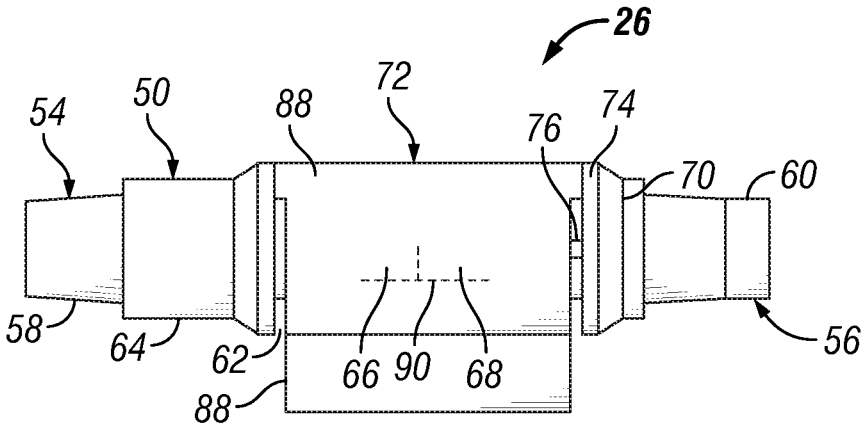
FIG. 5 is a front view of another example of a saver sub for use in the drilling system illustrated in FIG. 3, according to an embodiment of the present invention.
Figure 6:
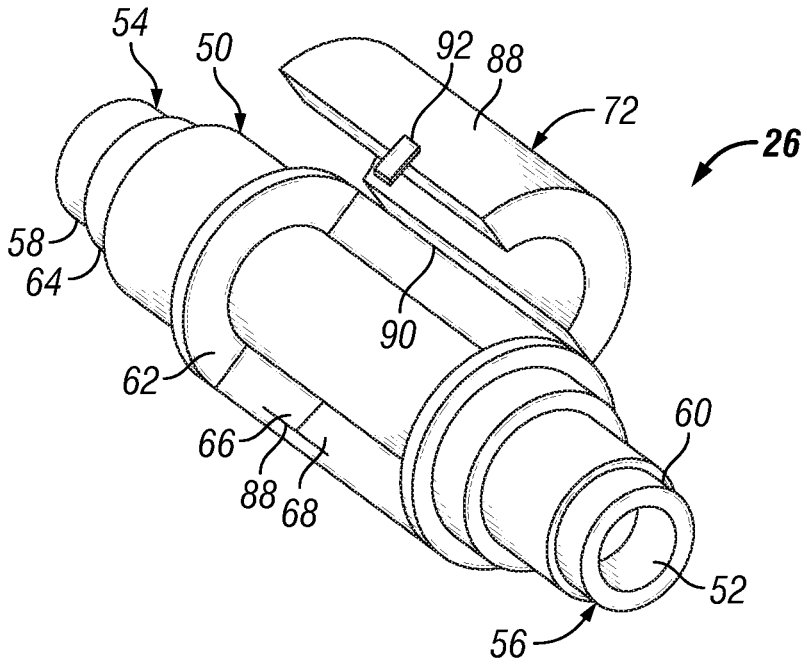
FIG. 6 is an orthogonal view of another example of a saver sub for use in the drilling system illustrated in FIG. 3, according to an embodiment of the present invention.

In FIGS. 5 and 6, an alternate embodiment of saver sub 26 is illustrated. In this embodiment, shell 72 is formed as a hinged shell having shell sections 88, e.g. shell halves, that are connected by one or more hinges 90. In this embodiment, the shell contact or contacts 76 can be formed as pin connectors that form an electrical connection with the one or more of the mandrel contacts 74. In this embodiment, contact or contacts 74 may be formed as corresponding pin connectors so that shell pin connectors 76 can stab into connectors 74 to establish electrical connections with the wired drill string 24 and the saver sub antenna 70.

Once the pin connectors are engaged, the remaining shell section(s) 88 can be pivoted until shell 72 fully resides in recessed region 62 of mandrel 50. As illustrated in FIG. 6, the shell sections 88 can be held in place in recessed region 62 by a latch 92. By way of example, the latch 92 may be positioned to extend from one shell section 88 to another when the shell sections are pivoted to a closed position around mandrel 50. Latch 92 further facilitates quick installation and removal of the shell section 72 to minimize operational downtime when, for example, replacing failed electronics or depleted batteries. In this embodiment, as in other embodiments described herein, the batteries 68 may comprise single use batteries or rechargeable batteries.

Figure 7:
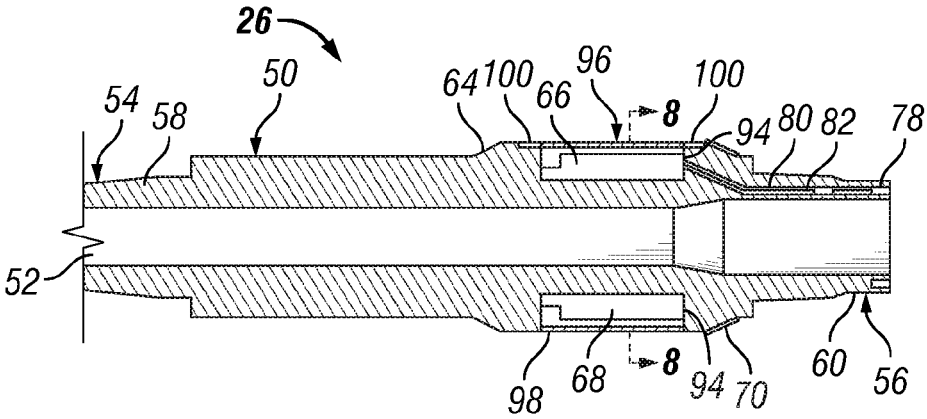
FIG. 7 is a cross-sectional view of another example of a saver sub for use in the drilling system illustrated in FIG. 3, according to an embodiment of the present invention.
Figure 8:
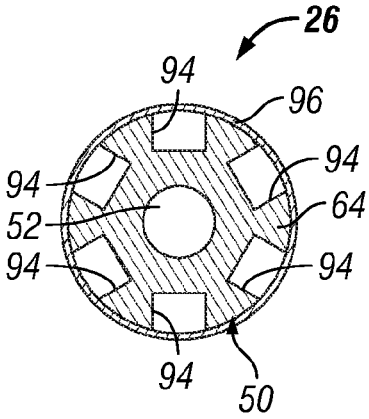
FIG. 8 is a cross-sectional view taken generally along line 6-6 of FIG. 7, according to an embodiment of the present invention.

In another embodiment, the electronics 66 and batteries 68 are positioned in one or more pockets 94 that extend radially inwardly into body section 64, as illustrated in FIG. 7. As further illustrated by the cross-sectional view of FIG. 8, a plurality of pockets 94 can be formed in body section 64 at desired angular positions depending on the configuration and number of components forming electronics 66 and batteries 68. Furthermore, a cover 96 can be selectively moved into place over pockets 94 to protect the electronics 66 and batteries 68 from damage. By way of example, cover 96 may comprise a cylindrical sleeve 98 that slides into place over pockets 94, or cover 96 may comprise individual plates that attach over each pocket 94. A plurality of seals 100 can be used to seal the cover 96 to mandrel 50, thereby preventing moisture and other undesirable substances from contacting the electronics and batteries.

Figure 9:
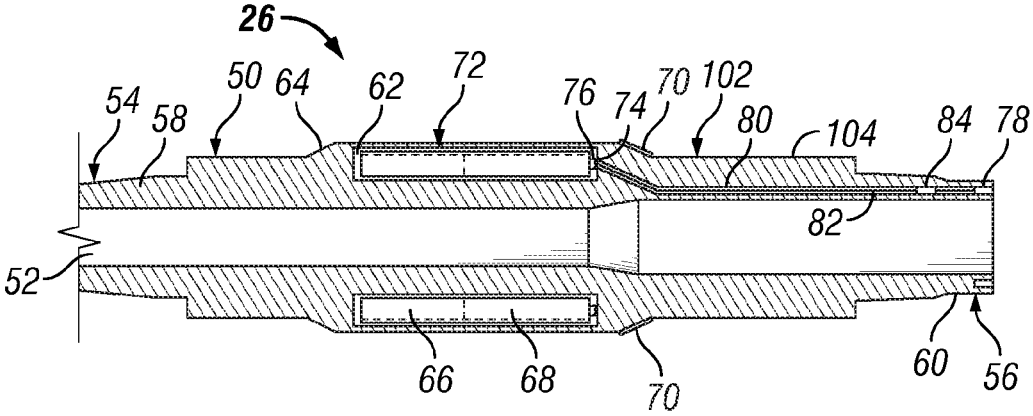
FIG. 9 is a cross-sectional view of another example of a saver sub for use in the drilling system illustrated in FIG. 3, according to an embodiment of the present invention.

In another embodiment, an extended section 102 is added to mandrel 50, as illustrated in FIG. 9. The extended section 102 is an axially extended section that provides a surface area 104 for gripping by automated tongs during attachment and removal of saver sub 26. The gripping surface 104 is separated from the electronics 66 to help avoid damage, even when the electronics remain attached to mandrel 50.

Figure 10:
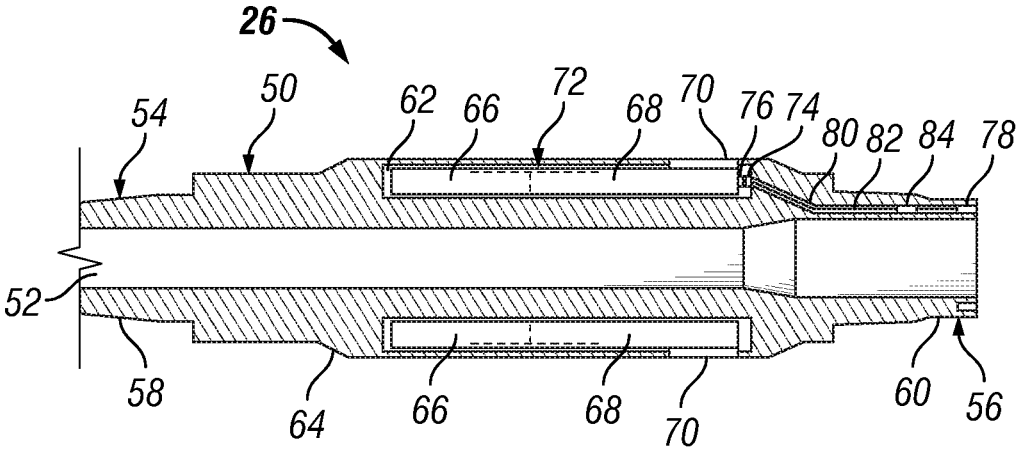
FIG. 10 is a cross-sectional view of another example of a saver sub for use in the drilling system illustrated in FIG. 3, according to an embodiment of the present invention.

Referring generally to FIG. 10, another embodiment of saver sub 26 is illustrated. In this embodiment, the saver sub antenna 70 is mounted to shell 72 rather than being mounted on body section 64 of mandrel 50. Positioning the saver sub antenna 70 on the shell 72 may facilitate direct electrical connection of the antenna 70 to the electronics 66 and further enables easy removal of the antenna when the shell 72 is removed. As a result, repair or replacement of the antenna 70 is simplified by allowing rapid removal of the antenna along with shell 72.

Figure 11:
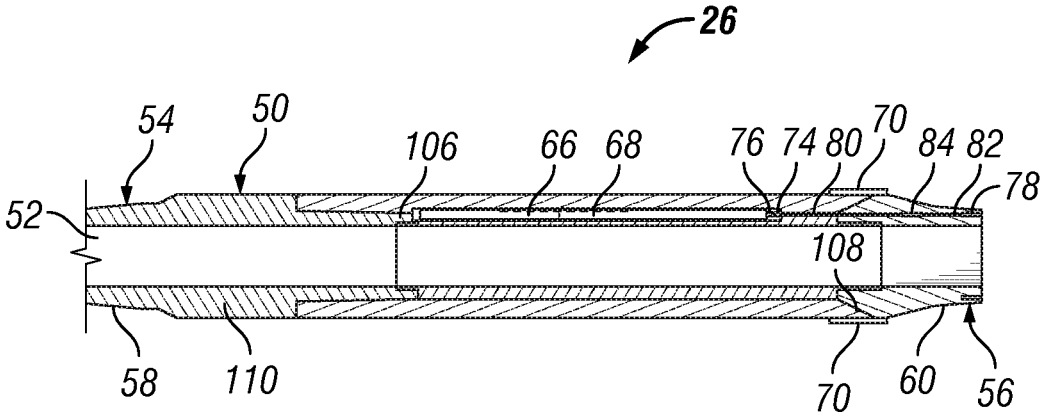
FIG. 11 is a cross-sectional view of another example of a saver sub for use in the drilling system illustrated in FIG. 3, according to an embodiment of the present invention.

In another embodiment, the electronics 66 and batteries 68 can be mounted on a chassis 106 that is removably attached to mandrel 50. For example, the chassis 106 can be designed for placement inside mandrel 50, as illustrated in FIG. 11. The chassis 106 can utilize contacts 76 designed to engage contacts 74 of mandrel 50 and to enable communication with both antenna 70 and wired drill string 24. The antenna 70 also could have a dedicated electrical connection 108. To enable loading of the chassis 106, this type of embodiment may utilize a box-up connection on the saver sub to gain advantage of a larger bore in the saver sub. A removable section 110 of the mandrel 50 can be employed to allow placement and retention of the chassis 106 within mandrel 50. In one embodiment, removable section 110 also may comprise the upper connection end 54 by which saver sub 26 is attached to top drive 22.

Generally, the well system 20 can be employed in a variety of wellbore drilling operations and other subterranean applications. In drilling applications, the wired drill string 24 may be constructed with different types of wired drill pipe sections and repeater subs. Additionally, the sensor assembly may comprise many types of sensors that are useful in obtaining data related to operation of the drilling equipment, characteristics of the wellbore, characteristics of the surrounding formation, and other parameters that can be useful in successfully managing the operation. Also, the types and amount of data transferred along wired drill string 24 and through saver sub 26 may vary from one application to another. Communication between control system 46 and saver sub 26 can be accomplished by radiofrequency signals or by other wireless techniques. Furthermore, the control system 46 may have a variety of forms depending on the data to be processed. For example, the control system 46 may comprise a processor based computer system, although the processing of data can be accomplished at one or more locations. In some applications, a portion of the control system 46 may be located downhole and the data processing can be performed at least partially by the electronics of the saver sub 26 or by other processors located in the drilling equipment. Furthermore, the configuration of the saver sub may be adapted to the physical parameters of the top drive and the drill string as well as to the data transfer requirements.

In an embodiment, a saver sub is constructed to connect a wired drill string to a top drive unit. Use of the saver sub may eliminate the requirement to torque and untorque drill pipe from the top drive when adding or removing drill pipes from the drill string. The saver sub may prevent damage to the threaded connection end of the top drive by shifting the making and breaking of connections with drill pipes to a lower connection end of the saver sub. For example, the saver sub may be connected directly to the top drive unit in a position directly under the top drive unit to protect the threaded connection end of the top drive. The saver sub may integrate electronics, a battery, and an antenna to enable the communication of signals between the control system and the wired drill string.

By integrating the electronics, batteries and antenna into the saver sub, signals transmitted through the wired drill string may be transferred through the saver sub and communicated to, for example, a control system or a processing system, e.g. a surface computer system. Data, such as control signals, may be transferred from the control system to the wired drill string system via the saver sub. In an embodiment, communication between the saver sub and the control system may be accomplished wirelessly via, for example, RF signals transmitted between antennas on the saver sub and the control system. Advantageously, the integration of electronics, one or more batteries, and one or more antennas into the saver sub enables the addition and removal of wired drill pipe joints during drilling or during pulling out of the hole without requiring handling of another sub component.

In an embodiment, the saver sub may be sized to enable insertion of a stand of drill pipe on the derrick, such as by using standard elevators, while enabling sufficient space for upward and downward movement under the derrick. For example, the saver sub may be approximately 2-3 feet in length, however other lengths may be utilized and may be dependent upon the size of the derrick. The saver sub may be capable of supporting the full weight of the drill string and maintaining a differential pressure as required under the drilling conditions, for example, 10 kpsi between an internal diameter through which a mud flow is conducted and an outer diameter exposed to atmospheric pressure. The saver sub may be designed to avoid damage to the electronics, batteries, and antennas when the saver sub is gripped and torqued by automatic tongs used to attach the saver sub to the top drive unit.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for use during drilling of a wellbore, comprising:

a top drive unit;

a drill string wherein at least a portion of the drill string comprises a plurality of wired drill pipes; and a saver sub to connect the drill string to the top drive unit, wherein the saver sub is positioned at the surface between the drill string and the top drive unit and further wherein the saver sub comprises a mandrel having a recessed region therein, electronics, a battery to power the electronics, and an antenna to relay and receive data; and a shell removably mounted in the recessed region of the mandrel, the shell comprising an attachment mechanism for quick installation and removal from the mandrel, the electronics and the battery positioned in the shell whereby the electronics and battery are removably mounted to at least a portion of the mandrel.

2. The system as recited in claim 1, wherein the saver sub is directly connected to the top drive unit and one of the wired drill pipes.

3. The system as recited in claim 1, wherein the antenna is positioned within an outer diameter of the saver sub.

4. The system as recited in claim 1, wherein the mandrel comprises conductors that electrically connect the electronics to one of the wired drill pipes of the drill string.

5. The system as recited in claim 1, wherein the electronics and the battery in the shell are disposed in pockets located in the mandrel.

6. The system as recited in claim 1, wherein the antenna is disposed in the shell.

7. The system as recited in claim 1, wherein the electronics and the battery are mounted to a chassis removably received in the saver sub.

8. A method to facilitate communication during drilling, comprising:

forming a saver sub mandrel having a recessed region therein and an antenna for wireless communication of data and electronics to facilitate data flow with respect to the antenna;

removably mounting the electronics and a battery to the saver sub mandrel by placing the electronics and the battery in a shell, the shell removably disposed in the recessed region of the saver sub mandrel, the shell comprising an attachment mechanism for quick installation and removal from the mandrel, the battery providing power to the electronics;

coupling a wired drill pipe to a top drive unit via the saver sub mandrel at the surface; and electrically connecting the electronics to the wired drill pipe.

9. The method as recited in claim 8, further comprising communicating data between the antenna and a surface processor system.

10. The method as recited in claim 8, wherein the antenna comprises a plurality of patch antennas joined with one or more micro-strips.

11. The method as recited in claim 8, wherein the removal shell has sections, the method further comprising connecting sections of the removable shell by a hinge.

12. The method as recited in claim 8, wherein removably mounting comprises placing the electronics and the battery in at least one pocket formed in the saver sub; and enclosing the electronics and the battery with a cover.

13. The method as recited in claim 8, wherein removably mounting comprises mounting the electronics and the battery in a chassis; and selectively placing the chassis in the saver sub.

14. A system, comprising:

a saver sub connectable between a top drive unit and a wired drill pipe at the surface, the saver sub comprising:

a mandrel having a recessed region;

an antenna mounted to the mandrel;

a battery mounted to the mandrel;

a shell removably disposed in the recessed region, the shell comprising an attachment mechanism for quick installation and removal from the mandrel; and electronics mounted to the mandrel within the shell, wherein at least one of the antenna, the battery, and the electronics is removably coupled to the mandrel, and wherein the electronics and battery are mounted in the shell.

15. The system as recited in claim 14, wherein the removable shell comprises electrical contacts that engage the mandrel to enable communication with the antenna and the wired drill pipe.

16. The system as recited in claim 14, wherein the antenna is mounted on the removable shell.

* * * * *